United States Patent [19]

van Berkum

[11] 3,945,191

[45] Mar. 23, 1976

[54] ELECTRONIC TIMEPIECE HAVING COMPLEMENTARY ELECTRO-OPTICAL AND ELECTRO-MECHANICAL DISPLAYS

[75] Inventor: Petrus A. van Berkum, Elmhurst, Ill.

[73] Assignee: Zenith Radio Corporation, Chicago, Ill.

[22] Filed: May 19, 1975

[21] Appl. No.: 578,701

Related U.S. Application Data

[62] Division of Ser. No. 432,935, Jan. 14, 1974, Pat. No. 3,911,665.

[52] U.S. Cl. ..... 58/4 A; 58/50 R; 58/58

[51] Int. Cl.[2] ..... G04B 19/24; G04B 19/30

[58] Field of Search ..... 58/4 A, 50 R, 58, 152, 58/127

[56] References Cited

UNITED STATES PATENTS

| | | | |
|---|---|---|---|
| 3,662,535 | 5/1972 | Hedrick et al. | 58/39.5 |
| 3,803,827 | 4/1974 | Roberts | 58/4 A |
| 3,815,351 | 6/1974 | Vovelle | 58/4 A |
| 3,884,035 | 5/1975 | Jeannet et al. | 58/152 R |
| 3,989,790 | 8/1975 | Takamune et al. | 58/50 R |

*Primary Examiner*—Edith Simmons Jackmon
*Attorney, Agent, or Firm*—John H. Coult

[57] ABSTRACT

This disclosure depicts an electronic timepiece having complementary electro-optical and electro-mechanical displays. The electro-mechanical time display comprises a stepping motor driving hour and minute hands to continuously display the hours and minutes of the day, the most used time functions. The electro-optical display is a normally off two-digit LED display which is activated by user command to display at least one additional time-related function having a lower normal use factor than hours or minutes. The complementary electro-optical and electro-mechanical time displays are controlled from a common control means.

4 Claims, 3 Drawing Figures

ELECTRONIC TIMEPIECE HAVING COMPLEMENTARY ELECTRO-OPTICAL AND ELECTRO-MECHANICAL DISPLAYS

CROSS-REFERENCE TO RELATED APPLICATION

This application is a division of a copending application Ser. No. 432,935, filed Jan. 14, 1974 now U.S. Pat. No. 3,911,665, entitled "Electronic Timepiece Having Complementary Electro-Optical and Electro-Mechanical Displays," assigned to the assignee of this invention and which is now Pat. No. 3,911,665.

BACKGROUND OF THE INVENTION

This invention relates to electronic timepieces, herein intended to mean timepieces of the type having an electronic oscillator, such as a quartz crystal oscillator, serving as a stable source of regular electrical pulses which constitute the time standard for the timepiece. To receive reasonable consumer acceptance, a modern electronic wristwatch or other body-worn timepiece must have certain basic features and capabilities, including the following (not necessarily in the order discussed). It must be accurate—errors of less than about 10 seconds per month are expected. Secondly, the power requirements must be sufficiently low so that frequent replacement of the battery or batteries is not required. Thirdly, in the case of wristwatches, the timepiece must be compact, particularly in the thickness dimension, in order that the watch does not interfere with clothing and is not otherwise burdensome to wear. Fourthly, the timepiece must be convenient in its operation and have a highly visible time display—preferably a display which is highly visible under low as well as high level ambient lighting conditions. Fifthly, the cost of acquiring and maintaining the timepiece must be reasonable.

This invention is applicable to horological instruments in general, however, it is believed to be most advantageously adapted for exploitation in a wristwatch; accordingly, the ensuing discussion will be based on wristwatch implementations of the invention. This invention is directed to providing an improved electronic watch, i.e., a watch having an electronic oscillator as a time standard and having either an electro-mechanical or an electro-optical time display. One type of commercially available electronic watch utilizes an electro-mechanical time display comprising a pulse-driven stepping motor coupled through a transmission (typically a gear train) to a set of hour, minute and second hands. The stepping motor may also drive ancillary time display devices such as day and/or date dials. Typically, the stepping motor input is a stable train of electrical pulses supplied from a logic circuit at a 1 Hz rate. The pulses cause the stepping motor rotor to incrementally advance one step per second. The rotor drives the watch second, minute and hour hands through an intermediate gear train.

A second general type of electronic watch is sometimes termed the "all electronic" or "all solid state" type which does not effect conversion of electrical energy to mechanical energy to display time functions, but rather employs an electro-optical time display. "Electro-optical" displays are herein intended to mean solid state or liquid state displays in which an optical pattern is created by the application of a pattern of voltages.

In such electro-optical displays the light-emitting or light-affecting (light-reflecting or light-absorbing) elements are arranged in segments, typically seven segments per digit displayed. The individual segments are selectively energized in patterns according to patterns of applied voltages to determine the digit displayed. There is typically provided between a quartz crystal oscillator and the electro-optical display a system of frequency dividers, counters and other appropriate logic circuitry and switches for appropriately determining the output reading of the electro-optical displays.

Each of the above-described types of electronic watches, i.e., those with electro-mechanical displays and those with electro-optical displays, are plagued by their own set of problems and limitations. The electronic watches which employ electro-mechanical displays are considered to be undesirably bulky and to consume an undersirably large amount of electric power. Such watches are non-innovative in the visual appearance of their time displays (typically conventional second, minute and hour hands with or without day or date dials), and thus hide from the consumer the innovative characteristics of the drive system for such watches. They also suffer from the long-recognized shortcoming of being difficult to read under low ambient lighting conditions.

Conventional electronic watches which have stepping-motor-driven displays and conventional date or day/date read-outs typically suffer also from a motor torque overloading at midnight. That is, at midnight, energy which has been stored in a spring by the stepping motor during the day is triggered to advance the day/date dial(s). The requirement that the stepping motor load the dial(s) advance spring is severe and can be as great as 4–5 times the normal motor loading.

The other type of electronic watch, namely the type having an electro-optical display for presenting time functions, also have drawbacks which have, to date, limited the market for such watches. The watches which employ LED (light-emitting diode) displays suffer from having undesirably large power requirements which necessitate that the time display be operated only on command. This is considered by many consumers to be a great inconvenience since he has not been accustomed to be thus inconvenienced to learn the time of day. Secondly, watches of the type having LED displays are more bulky than the consumer would like. They have, however, enjoyed prestige as a result of the novel, eye-catching light-emissive character of their displays. Electronic watches having LED displays are readable at night and thus have a significant advantage in this respect over non-self-illuminated time display devices.

Thirdly, in contrast with watches having a conventional mechanical display, the user of a watch with an electro-optical display is deprived of the advantage of computing the time interval between the present time and a future point in time by using the minute hand and the dial of his watch. Subconsciously nearly every watch user tends to do this. For example, if one has an appointment at 2:45 and one's watch indicates 2:25, the user simply determines the number of minutes left by counting on his dial the number of minutes between 2:25 and 2:45. This is definitely simpler than subtracting 2:25 from 2:45. Fourthly, LED displays cannot be read if the ambient light is very strong.

Electronic watches having electro-optical displays of the LC (liquid crystal) type utilize less power than watches employing LED's, however to date liquid crystal displays have not yet proven to have a satisfactorily long life. Liquid crystal displays also suffer from being inconvenient to read due to the low contrast of the display at certain viewing angles and in adverse lighting conditions. Electronic watches having LC displays have also proven to be undesirably cumbersome and bulky.

Attempts have been made to combine in an electronic watch the most favorable properties of electromechanical and electro-optical time displays. For example, U.S. Pat. No. 3,668,861—Mitsui, discloses an electronic watch which has electro-mechanically driven day and date displays and a pair of electro-optical hour/minute displays. The electro-optical hour/minute displays comprise discrete, parallel-functioning LC and LED displays. The parallel LC and LED displays are automatically switched by a phototransistor between the LC display during the day and the LED display when ambient lighting drops below a predetermined threshold level. The electro-optical displays present the hour and minute time functions on command only.

This prior art electronic watch thus suffers from the inconvenience of non-continuous presentation of the time functions and the high cost of providing parallel time displays for high and low ambient lighting conditions.

There is believed to be in commercial use in Japan today an electronic wristwatch having hour, minute and second hands driven by a train of pulses generated by a quartz crystal pulse generator, and in addition having an LED flashing seconds marker. This watch suffers from an unnecessarily larger power consumption and a low degree of utility and the redundancy of the information provided by the LED display.

| Other Prior Art U.S. Patents | |
|---|---|
| 3,712,047 | Girard |
| 3,738,099 | Tanaka |
| 3,737,746 | Ceilaszyk et al |
| 3,707,071 | Walton |

Hewlett Packard Measurement News, January/February, 1971.

OBJECTS OF THE INVENTION

It is a general object of this invention to provide an improved electronic timepiece, especially a timepiece of the wrist-worn variety.

It is a less general object to provide an electronic watch which has the consumer prestige of watches having electro-optical displays and yet has the relatively lower power requirements and continuous readability favorably associated with electronic watches having electro-mechanical displays.

It is yet another object to provide an electronic watch in which the hours and minutes time displays are, or may be caused to be, readily visible under any lighting conditions without the need for ancillary dial lighting apparatus. Stated more broadly, it is an object to provide an electronic watch having a non-light-emissive display and a complementary light-emissive display displaying complementary time-related functions, the light-emissive display serving to provide a source of illumination for the non-light-emissive display in low ambient lighting conditions.

It is yet another object to provide an electronic watch which has an electro-optical time display, which presents continuously the most-used time functions (hours and minutes) for wearer convenience, and yet which has relatively modest power requirements.

DESCRIPTION OF THE PREFERRED EMBODIMENTS

Figure 1:
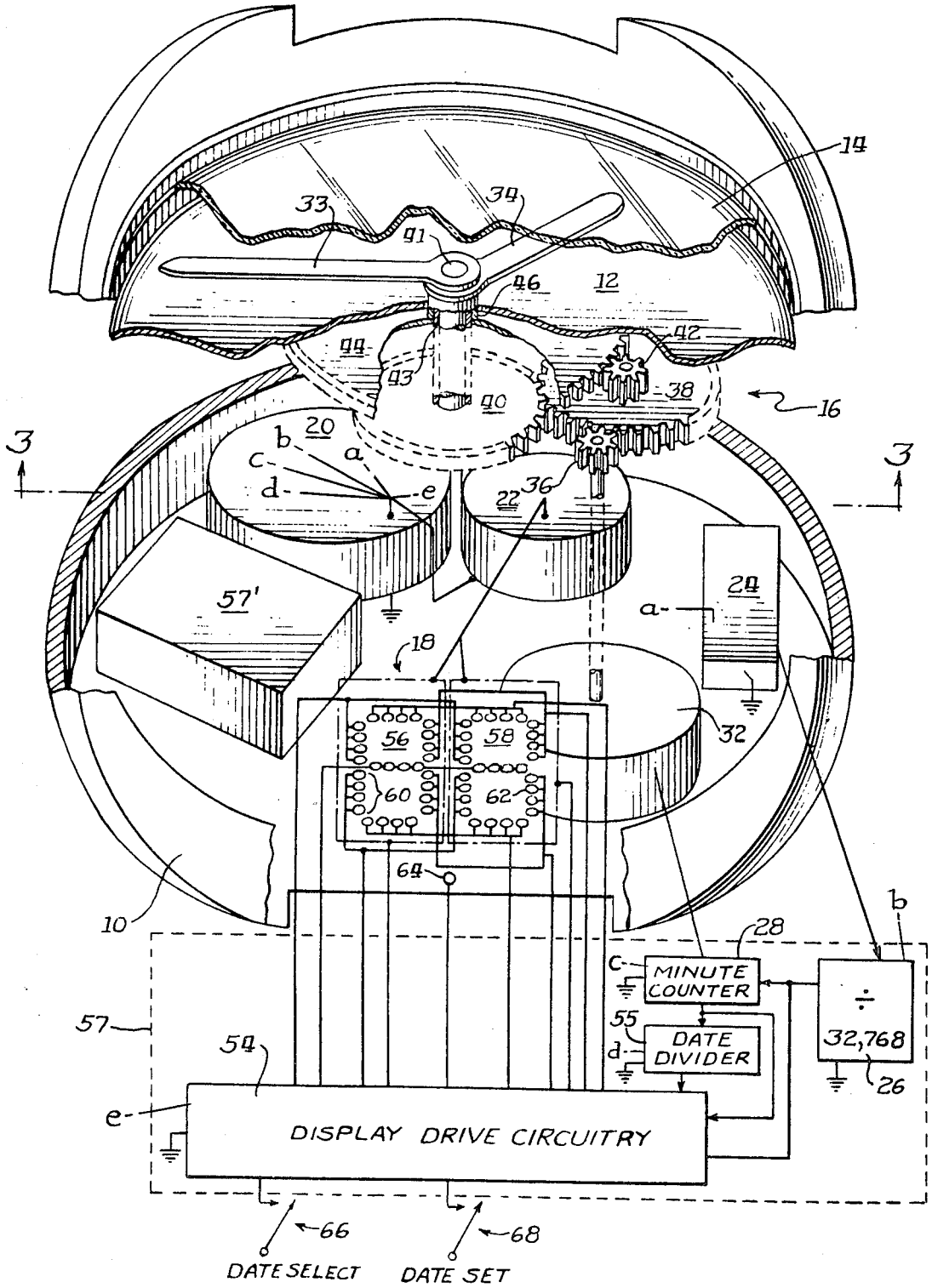
FIG. 1 is an exploded, somewhat schematic, perspective view, shown partly in structure and partly in block diagram form, of an electronic watch embodying the principles of this invention.

This invention has applicability to electronic timepieces in general, but is considered to be most advantageously implemented in a wristwatch. FIG. 1 depicts an electronic watch representing a preferred execution of the principles of the invention. The FIG. 1 watch is illustrated as comprising a housing 10 adapted to receive over the open top side thereof a dial 12 and a protective transparent crystal 14. As will be explained in much greater detail below, the watch embodies, in accordance with the teachings of this invention, means including an electronic oscillator for generating a train of highly regular pulses serving as the time standard for the watch, and complementary electro-mechanical and electro-optical displays for presenting time-related functions.

Before engaging in a detailed discussion of the structure and operation of the watch, a discussion of certain principles underlying the construction and operation thereof will be set forth. It was suggested above that conventional electronic watches having electromechanical displays suffer from having an undesirably high power consumption due to their simultaneous and continuous presentation of the "seconds" time function along with the "minutes" and "hours" time functions, and that such electro-mechanical displays also suffer from a lack of innovative appearance and poor visibility in adverse lighting conditions.

It was also noted that electro-optical displays suffered from their own set of drawbacks, including high power consumption in the case of LED (light-emitting diode) displays, and poor visibility and short life in the case of today's LC (liquid crystal) displays. It was also noted that conventional electronic watches having either electro-optical or electro-mechanical displays are undesirably bulky and inconvenient to wear.

Underlying this invention is the recognition that there are certain time functions which have a much higher use factor than others. For example, in a vast majority of the occasions upon which the wearer of a timepiece wishes to learn the time of day, he cares only to known the hours and minutes and does not need a reading to the nearest second. The frequency with which he seeks to know the day of the week or the date is relatively low by comparison with the frequency with which he wishes to know the time of day.

In accordance with one aspect of this invention, the time functions normally associated with body-worn timepieces, namely hours, minutes, seconds, day and date, are divided into two categories according to their normal or expected use factor. In one category, which is herein termed the high use factor or high duty category, is placed the hours and minutes time functions — those time functions which are necessary and sufficient to indicate the time of day to a degree of accuracy which is satisfactory except perhaps on rare occasions. In a second category are placed the remaining time functions which have a relatively low use factor — namely, seconds, day and date. These latter time functions are sought relatively infrequently by comparison with the frequency with which the time of day is sought. Another latter category time function is lapsed time.

For the convenience of the wearer, the time functions in the first category (hours and minutes) are presented continuously by means of an electro-mechanical display, preferably a stepping motor driving hour and minute hands through a conventional gear train. By relegating the seconds time function to the aforedescribed second category, the electro-mechanical display need only be actuated once per minute, rather than once per second, yielding a 60-fold reduction in motor power consumption over that required to continuously present the seconds time function as well as the hours and minutes time functions. This is accomplished without sacrificing the continuous readability of the time of day which the consumer has come to expect to be associated with timepieces.

One or more of the constituents of the second category of time functions (seconds, day and date) are presented to the wearer by means of an electro-optical display such as an LED (light-emitting diode) or LC (liquid crystal) display either intermittently or on command. Because the time functions in the second category have a relatively low use factor, it is not a major inconvenience to the wearer to have to access these time functions by command to the timepiece, or to be presented with these time functions by an intermittent readout. By this expedient of presenting the low use factor time functions on command or intermittent presentation only, substantial economies in power consumption are achieved.

As will become more obvious as this description proceeds, the allocation of time functions to complementary electro-mechanical and electro-optical displays according to their use factor achieves not only economies in power consumption but results in a watch which is highly compact, which has high visibility of all time functions under all lighting conditions, and which offers the prestige of electro-optical displays without the inconvenience of on-command-only readability associated with conventional electronic watches with electro-optical displays.

Turning now to a detailed discussion of the FIG. 1 watch — the watch is illustrated as comprising an electro-mechanical display 16 and a separate electro-optical display 18. The electro-mechanical and electro-optical displays 16, 18 are driven from a common electrical energy source, here shown as a pair of serially connected batteries 20, 22 which power a common source of electrical drive pulses. The common source of drive pulses includes an electronic oscillator, here shown in the form of a quartz crystal oscillator 24 which may, for example, be chosen to oscillate at a predetermined frequency such as 32,768 Hz. The quartz crystal oscillator 24 supplies pulses at 32,768 Hz to a frequency divider 26, here shown to have the capability of dividing by 32,768. At the output of the divider 26 there is developed regular pulses at the rate of 1 per second.

The 1 Hz pulses are supplied to a minute counter 28. From the minute counter pulses at the rate of 1 per minute are developed which are supplied to the electro-mechanical display 16.

The electro-mechanical display 16 is here shown as comprising a stepping motor 32 which drives a minute hand 33 and an hour hand 34 through a conventional gear train. The minute hand 33 is driven through a pinion 36, spur gear 38 and minute gear 40, to which is affixed a sleeve 43 carrying the minute hand 33. The sleeve rotates about a support post 41. The pinion 36 and gears 38, 40 effect a 10:1 gear reduction.

The hour hand 34 is driven at a 1/12 the rate of the minute hand 33 through gear 42 affixed to gear 38 which drives hour gear 44. A sleeve 46 affixed to the hour gear 44 carries the hour hand 34. A crown 47 provides for time setting; the associated gearing may be of conventional construction and is not shown.

In operation, the 1/60 Hz pulses emitted by the minute counter 28 cause the stepping motor 32 to rotate by 60° per pulse, resulting in a 6° rotation of the minute hand 33 for each minute pulse. The hour hand 34 is driven at a rate of 0.5° per minute pulse.

The electro-optical display 18 and the electronic circuitry associated therewith will now be described in detail. The electro-optical display 18 is illustrated as comprising a light-emissive cell and display drive circuitry 54 for driving the display cell. The drive circuitry 54 is, per se, constructed according to well-known circuit design principles, receiving pulses from a date divider 55 at 1 pulse per day, from the minute counter 28 at 1 pulse per minute and from the frequency divider 26 at 1 pulse per second and developing therefrom patterns of voltages determinative of the digits diplayed by the cell.

The cell is preferably of the light-emissive type such as LED's (light-emitting diodes) as shown. The cell is illustrated as comprising a pair of seven segment digits 56, 58, each segment (one of which is shown as 60) comprising a row of discrete light-emitting diodes (one of which is shown as 62). The seven segments of the digits and the ground electrodes are coupled by leads to the drive circuitry 54. As is conventional, corresponding segments of the digits 56, 58 are coupled together and separate ground electrodes provided to permit sequential energization of the digits and consequent reduction in the cost of the display.

The drive circuitry 54 comprises a system of counters, shift registers and other logic functions which act in accordance with a predetermined logic program, all as is well known, to convert the received 1 Hz, 1/60 Hz and one per day pulses to a pattern of voltages applied through the leads to determine the digit displayed.

The electronic circuitry for the watch (preferably wholly of integrated circuit form), i.e., those components shown schematically in FIG. 1 within the dotted line box 57, in actual structure are contained within package 57'.

The cell, in the illustrated preferred embodiment, also includes a single light-emitting diode, or group of diodes, acting as a seconds marker 64 which is caused to flash at a 1 Hz rate. In the illustrated preferred embodiment, the two digits 56, 58 are used to display the date on command by depression of a date select switch 66. The date select switch is shown schematically at 66 and is shown as it might appear in structure at 66', mounted on the watch housing for manual actuation by the user.

In accordance with one aspect of this invention, both of the time-related functions presented by the electro-optical display, namely the two digit date display and the seconds marker, are normally off and are energized only on command. The date display is energized by a manual command issued by the user; the flashing seconds marker 64 flashes automatically on commands from the drive circuitry 54. In both cases, since the electro-optical displays are activated on command only and have a relatively low duty cycle, rather than being continuously activated as is the case of the electro-mechanical display 16, presentation of the least-used time functions (by the electro-optical display 18) drain the batteries, 20, 22 only commensurately with their relative use factor.

The FIG. 1 system is illustrated as including, coupled to the drive circuitry 54, a date set switch 68 (shown in more structural form at 68'). Since the drive circuitry 54 and the associated switches 66, 68 constitute no part, per se, of this invention, they are disclosed herein only schematically. The construction of the drive circuitry 54 is within the routine skill of logic designers.

For a more detailed description and explanation of LED digital displays of a type suitable for use in the FIG. 1 watch, reference may be had to the abundant technical literature on the subject.

It is noted that whereas relatively low power consumption is a characteristic for the watches constructed according to this invention, nevertheless two batteries 20, 22 are illustrated. The reason for this lies in the fact that in the preferred embodiment, the electro-optical display 18 is of the LED variety. LED displays of the type commercially available at this time require a voltage which can only be obtained by adding in series two batteries of the commercially available type suitable for use in wristwatches.

It is desired to provide an electronic watch movement which is more compact than conventional electronic watch movements with comparable functions. The compactness of watch movements implementing this invention is achieved by two provisions. First, battery 20 has a relatively large physical size and storage capacity, however, the battery 22, which is connected in series with battery 20, is preferably caused to have a relatively small physical size and storage capacity. The collective space occupied by the watch batteries is substantially reduced over what it would be if two relatively large batteries were employed.

Figure 2:
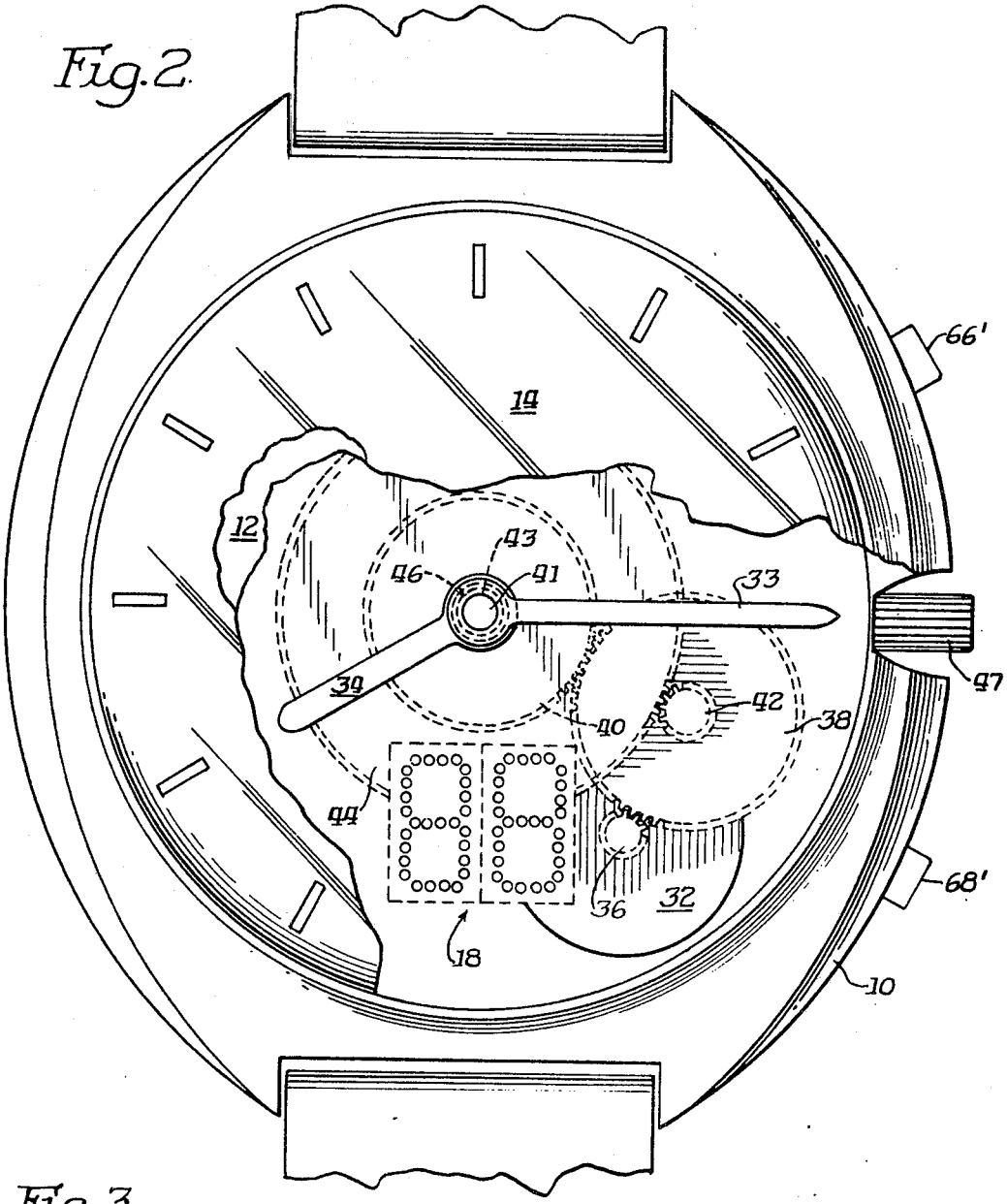
FIG. 2 is a view of the FIG. 1 watch as it would appear from the top with the crystal and dial removed.
Figure 3:
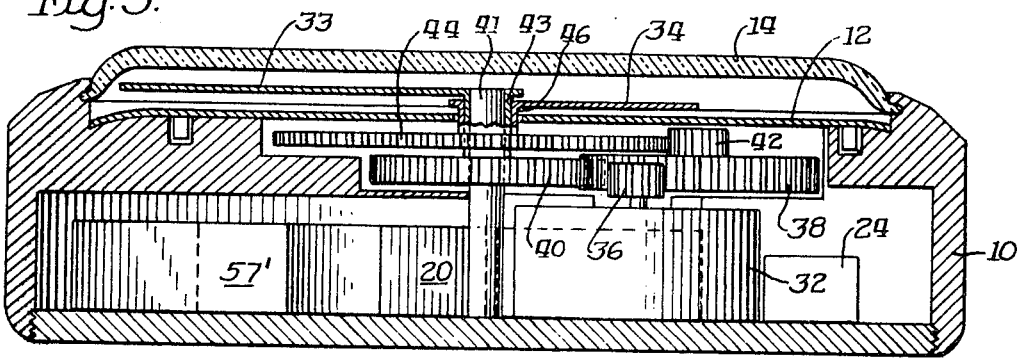
FIG. 3 is a section view taken generally along the lines 3–3 in FIGS. 1 and 2.

An electronic watch as shown in FIGS. 1–3, incorporating the teachings of this invention preferably includes the following components with the indicated major dimensions: motor 32 — 7 × 3.2 mm; quartz crystal 24 — 13.8 × 3.3 × 4.3 mm; two digit LED display 18 — 9 × 6.5 × 1.5 mm; trimming capacitor (not shown) — 5 × 2 mm; integrated circuit package 57' — 10 × 6.6 × 3.6 mm; battery 20 (silver oxide, 1.5 volts, 120 mAH) — 11.4 × 4.3 mm; and battery 22 (silver oxide, 1.5 volts, 38 mAH) — 7.6 × 3.5 mm.

If two batteries having the specifications of battery 20 were employed, the described electronic watch would have a movement outer diameter of about 32 mm. By causing the battery 22 to be a relatively small, low capacity battery, having the described specifications for battery 22, the movement outer diameter may be reduced to about 28 mm.

The electro-optical display 18 requires a voltage equal to the sum of the voltages produced by the batteries 20, 22; therefore the electro-optical display 18 is coupled across the series combination of batteries 20 and 22. The integrated circuit components 57 comprising the quartz crystal oscillator 24, frequency divider 26, minute counter 28, date divider 55, and part of the drive circuitry 54, are all coupled across only the battery 20, as shown schematically by the ground symbol and battery connection conductor on each of these components. The battery connection conductors are shown in interrupted form for clarity of illustration; the interruptions are tied by the break symbols *a—a, b—b, c—c, d—d* and *e—e,* respectively. The electro-mechanical display may be coupled across battery 20 or the series combination of batteries 20 and 22 since its current drain is low compared with that of either the LED display 18 or the components 57.

The power drain by the LED electro-optical display is relatively low, since it is read out on command only; the motor 32 requires a drive pulse only once per minute. The series combination of batteries 20 and 22, as described, is very adequate to power the watch. The lifetime of the batteries 20, 22 under normal use is expected to be 1 year or greater.

As described, the teachings of this invention result in an electronic watch having an LED display and having the favorable characteristics described, yet which consumes so little power that the unusually small batteries described may be used. This results in an extremely small watch by comparison with other electronic watches having LED displays. There is set forth below a comparison of the sizes of the batteries used in the FIGS. 1–3 watch movement with the sizes of the batteries used in certain commercially now available quartz crystal controlled, all-LED display wristwatches:

| | Number of Batteries | Battery Diameter in mils | Battery Thickness in Mils |
|---|---|---|---|
| Brand A | 2 | 709 | 190 |
| Brand B | 2 | 455 | 220 |
| Brand C | 2 | 455 | 220 |
| FIGS. 1–3 | 1 | 455 | 170 |
| watch movement | 1 | 305 | 140 |

The above table reveals the substantial space economies made possible by the teachings of this invention.

It is an object of this invention to provide illumination for a non-light-emissive display in low ambient lighting conditions (here shown as being the electro-mechanical display 16) without the need for a lamp or other special purpose lighting apparatus. This objective is met by the use of an electro-optical display of the light-emissive type, such as the LED display described. The electro-optical display may be operated in a number of modes to achieve this end without causing unnecessary drain on the batteries 20, 22. A first mode is to cause the electro-optical display, in whole or in part, to flash intermittently. This mode is performed by the above-described seconds marker 64 which is caused to flash at a 1 Hz rate.

A second mode is implemented in the date display portion of the electro-optical display 18 which is energized only on command by the user. In low light level conditions, the date may be accessed by closing date switch 66 to obtain a reading of hours and minutes in the light cast by the activated digits 56, 58. It is contemplated that in alternative embodiments, other user-commandable displays may be used to achieve the afore-stated object of providing a light-emissive time display acting secondarily as a source of illumination for a complementary non-light-emissive time display.

Whereas a number of alternative embodiments of the invention have been described above, many others are contemplated. The particular structure of the electro-optical displays, the nature of their presentations, and the switches and logic for accessing these functions may be varied from the above disclosures. By way of example, a single pair of electro-optically displayed digits (without a flashing seconds marker) can be presented which are capable of displaying, on command by the user, either the seconds of the day, or alternatively the date. The teachings of this invention may be employed in timepieces other than wristwatches, however for the above reasons it is manifest that the invention is most advantageously exploited in a wristwatch.

The invention is not limited to the particular details of construction of the embodiments depicted and other modifications and applications are contemplated. Certain other changes may be made in the above-described apparatus without departing from the true spirit and scope of the invention herein involved and it is intended that the subject matter in the above depiction shall be interpreted as illustrative and not in a limiting sense.

What is claimed is:

1. A compact electronic watch capable of displaying multiple time-related functions at relatively low levels of power consumption, comprising within a housing;

battery means for storing electrical energy;

pulse-drivable electro-mechanical time display means for displaying only the hours and minutes of the day, said electro-mechanical time display means comprising an hour hand and a minute hand, a stepping motor, and means including a gear train for mechanically coupling said stepping motor to said hour and minute hands;

a normally-off, two-digit LED (light-emitting diode) display for displaying at least one additional time-related function having a lower normal use factor than hours and minutes, such as seconds or the date;

manually operable switch means for causing said LED display to be activated only on command by the user; and control means coupled directly to said battery means, directly to said stepping motor, and indirectly to said LED display through said switch means, said control means including pulse generating means for generating a train of highly regular electrical pulses for supply to said stepping motor to drive said hour and minute hands in order that hours and minutes, the most-used time functions, are displayed continuously for the convenience of the user, said control means developing a control signal for activating said LED display upon closure of said switch means.

2. The watch defined by claim 1 wherein said pulse generating means includes a quartz crystal oscillator and a frequency dividing means for deriving pulses at a 1/60 Hz frequency for supply to said stepping motor, said control means including pulse processing circuitry for receiving said 1/60 Hz pulses from said frequency dividing means and for developing patterns of voltages for application to said LED display.

3. The watch defined by claim 2 wherein said LED display being disposed such that light emitted thereby illuminates said hour and minute hands, whereby in dark ambient lighting conditions, said switch means may be activated to effect an illumination of said hour and minute hands.

4. The watch defined by claim 3 wherein said battery means includes a first electric storage battery having a relatively large physical size and storage capacity connected in series to a second electric storage battery having a relatively small physical size and storage capacity, said watch including connecting means for coupling said control means across said first battery only and for coupling said LED display across said first and second batteries in series.

* * * * *